United States Patent [19]

Koblin

[11] Patent Number: 4,708,869

[45] Date of Patent: Nov. 24, 1987

[54] PERSISTENT INCAPACITATING CHEMICAL WARFARE COMPOSITION AND ITS USE

[75] Inventor: Abraham Koblin, Baltimore, Md.

[73] Assignee: The United States of America as represented by the Secretary of the Army, Washington, D.C.

[21] Appl. No.: 855,078

[22] Filed: Sep. 2, 1969

[51] Int. Cl.[4] ..... A61K 31/66; A61K 31/78

[52] U.S. Cl. ..... 424/81; 102/370; 424/409; 514/137; 514/139; 514/958

[58] Field of Search ..... 424/14, 220, 221, 409, 424/484, 81; 514/137, 139, 958

[56] References Cited

U.S. PATENT DOCUMENTS

| | | | |
|---|---|---|---|
| 1,835,970 | 12/1931 | Savage | 40/213 |
| 2,465,357 | 5/1949 | Correll | 424/14 X |
| 3,382,147 | 5/1968 | Proctor | 424/221 X |
| 3,417,181 | 12/1968 | Cardarelli | 424/14 X |

*Primary Examiner*—Richard D. Lovering

*Attorney, Agent, or Firm*—Anthony T. Lane; Harold H. Card, Jr.

[57] ABSTRACT

A method and composition for causing casualties among mammals by contacting a composition comprising casuality producing chemical agents, thickener and open multicellular polymer and said composition covering various external surfaces.

6 Claims, No Drawings

PERSISTENT INCAPACITATING CHEMICAL WARFARE COMPOSITION AND ITS USE

DEDICATORY CLAUSE

The invention described herein may be manufactured, used, and licensed by or for the Government for governmental purposes without the payment to me of any royalty thereon.

This invention relates to chemical warfare compositions of matter and their deployment on various surfaces.

The object of this invention is to provide a new and useful composition of matter particularly adapted to adhere to and prolong the level of contamination in the treated area.

A further object of this invention is the method of causing casualties among mammals by traversing the novel compositions whereby the mammals are no longer capable of carrying out their assignment.

A further object of this invention is the utilization of multicellular polymers as retention aids for chemical warfare agents.

The former methods of increasing the level of contamination in reference to time have been compositions incorporating various thickeners with the chemical warfare compounds. The compositions were unsuitable since the contamination level was insufficient for our present military needs.

As a result of my investigation, the level of contamination for the same time period can be increased by a factor of about 38 and 19 over the neat agent and agent plus thickener, respectively.

The conventional compositions of matter for contaminating the terrain to incapacitate or deny entry of hostile troops are of short duration thereby requiring the continuing task of replacing the composition to the area. This rebuilding of the contamination level is unsatisfactory in view of the fact that it is not only costly and time-consuming but the increased danger of effecting the friendly personnel replenishing the toxic material. An investigation was instituted to seek new routes resulting in maintaining an effective contamination level over a prolonged period of time thereby endangering troops either entering, occupying or traversing the treated area.

The compositions of this invention will adhere to and cover the surfaces of the various structures traversed by the combat soldiers or other human beings in carrying out their mission, for example, in the urban areas the roads and buildings, in the jungle, forest and farming areas, the various forms of vegetation, and in the military stores, the various mechanized equipment.

The composition of this invention is prepared by stirring a mixture comprising 0.5% to 8% of a polymeric thickener, and 0.5 to 10% of multicellular polymer into the chemical warfare agent under an inert gas atmosphere; the expressed percentages are based upon the proportion of agent. The mixing step may require from a few hours to 24 hours in order to achieve complete mixing of all components due to the high viscosity of the final composition.

The casualty producing compounds employed in this invention are well established in the military arsenal and are effective upon contacting any part of the skin or through normal clothing systems which are not rendered resistant to chemical agents. The compounds are nerve and blistering agents. The nerve agents are dimethylaminoethyloxy-cyanophosphine oxide, methylisopropoxyfluoro-phosphine oxide, methylpinacolyloxyfluorophosphine oxide, and O-ethyl-S-diisopropylaminoethyl methylphosphonothiolate. The blistering agents are 2,2'-dichlorodiethyl sulfide, 2,2' dichloro-triethylamine, 2,2'-dichloro-diethylmethylamine, 2,2',2''-trichlorotriethylamine, dichloroformoxime, dichloro(2-chlorovinyl)arsine, phenyldichloroarsine, ethyldichloroarsine, methyldichloroarsine, and a mixture of dichloro(2-chlorovinyl)arsine and 2,2'-dichloro-diethyl sulfide in the ratio 63:37::50:50 respectively.

The retention substrate in this invention can be organoplastic polymers having an open, expanded multicellular structure. The only requirement of the substrate is that there be no detrimental interaction between the multicellular structure and the agent. Therefore, the various pigments, fillers or other additives described in the following patents are usually omitted for the purpose of the present invention. Examples of such multicellular materials are thermoplastic polymers described by Reed in U.S. Pat. No. 2,804,435 and Fuller in U.S. Pat. No. 2,776,265; polymeric isocyanate containing compositions of Sternemann in U.S. Pat. No. 2,577,381 and Simon et al in U.S. Pat. No. 2,698,838; phenolics of Sterling in U.S. Pat. No. 2,653,139 and Simon et al in U.S. Pat. No. 2,798,054; silicone polymers of Weyer in U.S. Pat. No. 2,833,732; epoxy resin of Aase et al in U.S. Pat. No. 2,831,820. Examples of the more specific multicellular polymers described in the aforementioned patents are polyethylene, alkyl resins from oxalic acid and polyhydric alcohol with meta-toluene diisocyanate, phenol-aldehyde resins, silicone resins prepared from an organic resin and organosilioxane resin or epoxy resin prepared from reacting bis-(4-hydroxyphenyl)-2,2-propane and epichlorohydrin.

The various methods for preparing styrene polymers and acrylic acid ester polymers where employed in this invention as thickeners are well documented in "Styrene Its Polymers, Copolymers and Derivatives" Edited by Ray H. Boundy et al, American Chemical Society Monograph Series, Reinhold Publishing Corporation, N.Y. (1952) and the polymeric acrylic acid esters described by Lai in U.S. Pat. No. 2,833,741.

The preparation of toxic compound, o-ethyl-S-diisopropylaminethyl methylphosphonothiolate, Example 1, and its corresponding method of determination, Example 2, were the result of classified research and does not form part of the inventive portion of this invention.

EXAMPLE 1

The method comprising an alkaline solution, pH10, comprising about 50.0 ml of 0.4M sodium hydroxide in water was added to about 100 ml aqueous solution containing about 9.17 g (0.04 moles) potassium ethyl methylphosphonothiolate, and then adding an alkaline solution, pH10, of beta-chloroethyl diisopropylamine. The solutions are mixed and allowed to stand for about 5 minutes. The pH of the solution is between 10.0 to 10.5 and after 5 minutes about 50.0 ml of 0.04M acetic acid was added and pH dropped to about 5.15. The pH is adjusted and maintained at 10.5 with subsequent extraction with diethyl ether. The extract is dried over anhydrous sodium sulfate distilled and then collecting o-ethyl-S-diisopropylaminoethyl methylphosphonothiolate.

The testing procedure, results tabulated in Table 1, utilized freshly cut sod, consisting of dense growth of short grass on 2 inches of soil was placed in metal trays and divided into six lanes each measuring 5 inches by 22 inches. Each composition was dispersed over the appropriate test lane. The neat agent composition was dispersed as drops from a hypodermic syringe with a fine needle, the agent with thickener was dispersed as a filament and the modified composition was deposited with tweezers. At the end of a 24 hour interval after deposition of the composition, a cloth covered brass roller, measuring 3 inches in diameter, 5 inches in width and weighing 5.4 kg was rolled across each lane. The agent picked up, recovered, on the bleached 8.5 oz cotton sateen cloth was extracted with isopropanol and quantitatively determined, Example 2, thus indicating the pickup or recovery contamination level the troops running, falling or crawling would encounter traversing the treated area.

EXAMPLE 2

A test tube containing a mixture comprising 2.0 ml aliquot of the isopropyl alcohol extract was added to 1.0 ml of a hydrolysis solution, defined below, and 3.0 ml of hydrogen peroxide and then shaking; the mixture was heated in a bath (water-ethylene glycol mixture) at a temperature of 107° C. for about 45 minutes or until all the moisture is completely evaporated and then cooling the tube to room temperature, a white dry salt residue; add about 7 ml of Solution C, defined below, to said residue, shake and then place tube in a 100° C. water bath for about 10 minutes, remove and cool in a cool water bath. Read the developed color, phosphate, in a colorimeter using a No. 66 filter.

Hydrolysis solution is prepared by the steps comprising to a 500 ml flask, add 100 g of sodium sulfate and 5 ml of 0.1N sodium hydroxide solution and dilute to volume.

Solution C, stable for about 2 hours, comprises 10 ml Solution A and 20 ml Solution B. Solution A (5N adjusted to bromthymol blue end point) is prepared by the steps comprising to a 500 ml flask, dissolving 5 g of ammonium molybdate in 200 ml water, then add 70 ml concentrated sulfuric acid (specific gravity 1.84 and containing 98% $H_2SO_4$ by weight) and dilute to volume. Solution B is prepared by the steps comprising to a 500 ml flask, add 5 g hydrazine sulfate and dilute to volume.

Table 1 arranges the experimental results of the comparison of the neat agent, agent with thickener, and modified agent which is illustrative of the compositions of this invention. It will be noted that there are two sets of average values for the neat and agent with thickener, that is, actual and projected values for the 24 hour time sequence. The insertion of the projected value based upon the actual value is deemed necessary in order to properly compare the data in view of the fact that the highly viscous composition with the thickener and modified composition of this invention presented insurmountable problems in generating identical test runs based upon the proportion of the agent. An extrapolation technique was utilized in arriving at the projected values for comparative purposes wherein the actual value of 157.1 mg of the modified agent is employed as the base value for comparing the results of experiments in Table 1. Therefore, that actual value of 144.4 mg (neat agent) and 146.5 mg (agent with thickener) and their related recovered value was projected as a linear function to the base value 157.1 mg of modified agent. For example, the projected value for the proportion of recovered neat agent as a linear function of 144.4 mg to the base 157.1 mg is $157.1 \times 0.75 \div 144.4 = 0.82$ mg (projected value, recovered)

TABLE 1

| Composition | Time (hrs) | Agent Dispersed (mg) | Agent Recovered (mg) | Agent Recovered (Percent) |
|---|---|---|---|---|
| Neat Agent[1] | 24 | 144.4[a] | 0.75[a] | 0.50[a] |
| (control) | | 157.1[p] | 0.82[p] | 0.55[p] |
| Agent with | 24 | 146.5[a] | 1.35[a] | 0.95[a] |
| Thickener[2] | | 157.1[p] | 1.45[p] | 1.02[p] |
| Modified[3] | 24 | 157.1[a] | 30.1[a] | 19.2[a] |

[1]O—ethyl-S—diisopropylaminoethyl methyphosphonothiolate with 4% dicyclohexylcarbonimide, stabilizer.
[2]Above defined agent with 1% polyisobutyl methacrylate, thickener.
[3]Above defined agent, 1% polyisobutyl methacrylate and 2% polyethylene, multicellular polymer.
[a]Actual experimental value.
[p]Projected value based upon linear extrapolation.

The data from Table 1 indicates that 24 hours after contamination the persistence of the agent is significantly enhanced by the compositions of this invention by a factor of approximately 38 and 19 fold over the neat agent and agent with thickner, respectively.

The methods of disseminating the incapacitating composition of this invention may be achieved by dispersion with standard military munitions, dropping the composition in rupturable containers, or spray tanks from aircrafts, and the manual dispensing by tilting a container or forcing the composition from a confined area. The standard munitions can be land mines and various projectiles wherein their payload fill, for example, incendiary, toxic, smoke or explosive, is replaced with the chemical warfare composition of this invention. Examples of the munitions are the chemical mines, M-23, as disclosed on pages 102 et seq. of the Department of the Army Technical Manual (TM-9-1345-200), the chemical bombs and bomb clusters, as disclosed on pages 3–5, 16 et seq. and 34 et seq; mortar shells constructed in accordance with U.S. Pat. No. 1,812,010 to McBride, and rockets constructed according to U.S. Pat. No. 2,941,468 to Greene.

EXAMPLE 3

A mixture prepared by stirring 0.5 to 8.0% of a thickener for the chemical warfare agent and 0.5% to 10.0% of a multicellular polymer into a chemical warfare agent in an inert atmosphere (nitrogen) with a thorough mixing of the components. The mixing time varies from a few hours to about 24 hours depending upon the viscosity of the final composition which is apparent to those skilled in the art.

EXAMPLE 4

(a) A mixture comprising stirring about 50 g (1%) of polyisobutyl methacrylate and 100 g (2%) of multicellular polyethylene into 5000 g of O-ethyl-S-diisopropylaminoethyl methylphosphonothiolate under a dry nitrogen atmosphere. Approximately 2 to 4 hours are required to achieve thorough dispersion of all the components in the composition.

(b) The procedure in (a), supra, was repeated with the exception of 2,2'-dichloroethyl sulfide for the methylphosphonothiolate.

(c) The procedure in (a) and (b) were repeated with the exception of utilizing 500 g (10%) for the 100 g (2%) proportion of the polyethylene.

(d) In procedures (a), (b) or (c), supra, other nerve agents or blistering agents may be substituted for the corresponding methylphosphonothiolate or sulfide and other multicellular polymers for the polyethylene producing corresponding incapacitating compositions.

EXAMPLE 5

(a) A mixture comprising stirring 5.0 g (0.5% of polyisobutyl methacrylate or polystyrene and 5.0 g (0.5%) of a multicellular polymer, a reaction product of polyvinyl chloride with mono-isocyanate of the formula R-N: C:O where R is alkyl or aryl radicals, into 1000 g of dimethylaminoethyloxy-cyanophosphine oxide or dichloro(2-chlorovinyl)arsine under a dry nitrogen atmosphere requiring about 1 to 2 hours for adequate mixing.

(b) The procedure in (a), supra, was repeated utilizing 80.0 g (8.0%) of the thickener, and 100.0 g (10.0%) of the multicellular polymer with an appropriate increase in stirring time to about 22–24 hours.

(c) The procedure in (a) or (b), supra, was repeated utilizing other nerve or blistering agents and other multicellular polymers giving rise to corresponding incapacitating compositions.

I claim:

1. A persistent incapacitating composition for chemical warfare on land containing 100 parts by weight of at least one chemical warfare nerve agent or blistering agent, about 0.5 to 8 parts by weight of a synthetic polymeric thickener for said agent, and about 0.5 to 10 parts by weight of a synthetic multicellular polymer.

2. Composition according to claim 1 wherein said agent is a nerve agent.

3. Composition according to claim 1 wherein said agent is a blistering agent.

4. Method of incapacitating mammals on land comprising disseminating on a land surface a persistent composition containing 100 parts by weight of at least one chemical warfare nerve agent or blistering agent, about 0.5 to 8 parts by weight of a synthetic polymeric thickener for said agent, and about 0.5 to 10 parts by weight of a synthetic multicellular polymer.

5. Method according to claim 4 wherein said agent is a nerve agent.

6. Method according to claim 4 wherein said agent is a blistering agent.

* * * * *